US005918320A

United States Patent [19]

Reals

[11] Patent Number: 5,918,320

[45] Date of Patent: Jul. 6, 1999

[54] HOUSING FOR A TOILET SANITIZING DISK

[76] Inventor: Jeffrey W. Reals, 408 Tyson Pl., Syracuse, N.Y. 13206

[21] Appl. No.: 09/109,547

[22] Filed: Jul. 2, 1998

[51] Int. Cl.[6] ..... E03D 9/00

[52] U.S. Cl. ..... 4/225.1; 4/222

[58] Field of Search ..... 4/225.1, 223, 222, 4/224, 226.1, 227.1, 231; 222/190

[56] References Cited

U.S. PATENT DOCUMENTS

| | | | |
|---|---|---|---|
| 3,444,566 | 5/1969 | Spear | 4/225.1 |
| 5,125,119 | 6/1992 | Munoz | 4/225.1 |
| 5,815,850 | 10/1998 | Shon | 4/225.1 |

*Primary Examiner*—David J. Walczak
*Attorney, Agent, or Firm*—George R. McGuire

[57] ABSTRACT

A housing for a conventional sanitizing disk for attachment in series between a toilet's fill tube and an overflow tube. The housing generally includes a body portion (or container) having a planar, bottom wall, a contiguous sidewall extending upwardly therefrom, a lid hinged to the sidewall, and a rigid conduit extending tangentially outwardly from the sidewall and in fluid communication with the interior of the body portion. An opening is formed centrally through the bottom wall, and a tubular neck portion extends concentrically downwardly from the bottom wall and into the overflow tube, thereby positioning the housing atop the overflow tube. A flexible conduit extends in fluid communication between the fill tube and the rigid conduit, and consequently, the body portion. A cup for containing the sanitizing disk sits loosely within the body portion, and includes an opening formed centrally through the bottom thereof, and a gear fixedly and concentrically attached to the bottom thereof. A water turbine is positioned immediately beneath the cup and, as water enters the body portion, causes the cup to rotate and the water to pass over the sanitizing disk.

8 Claims, 5 Drawing Sheets

38
60
10
54
56
52
59
50
48
44
46
32
36
42
40
62

HOUSING FOR A TOILET SANITIZING DISK

BACKGROUND OF THE INVENTION

The present invention generally relates to devices for purifying the water in a toilet tank, and more specifically, to such devices which do not contribute to the corrosion of a toilet's plumbing fixtures.

Toilets generally include a water filled bowl portion and a tank portion which acts as a reservoir for the bowl portion, and from which water is supplied to the bowl each time it is flushed. The tank includes a fill tube through which fresh water enters the tank, and an overflow tube through which water exits the tank and flows into the bowl. While fresh water is added to the tank each time a toilet is flushed, due in part to environmental factors, in between uses the water becomes somewhat contaminated and odorous. Moreover, as this water moves from the tank to the bowl, germs become built up on the bowl's surfaces and the bowl's surfaces become stained, among other things.

In order to remedy these unpleasantries and improve the sanitary conditions of the toilet, various types of sanitizing additives and apparatus were developed. A common sanitizing agent is detergent, such as chlorine, compacted into a disk which may be placed in the tank. The detergent slowly dissolves as it cleanses the water. While the sanitizing disks do effectively clean the water, their chemicals also degrade and corrode the various plumbing fixtures present in a tank, such as the flapper valve, ballcock, fill tube and overflow tube.

To prevent degradation of the fixtures, housings were developed to contain the sanitizing disks. These housings were generally positioned in line between the fill and overflow tubes in order to ensure that water leaving the tank and entering the bowl would first pass over the sanitizing disk. Various arrangements of these housings can be readily seen and studied in U.S. Pat. Nos. 2,570,934 to Foster; 3,290,698 to Jayner et al; and 3,311,931 to Kristensen et al.

It is a primary object and advantage of the present invention to provide a new and improved housing for a toilet sanitizing disk that effectively prohibits degradation of a toilet's plumbing fixtures.

It is another object and advantage of the present invention to provide a housing for a toilet sanitizing disk that is easily installable on existing toilets.

It is a further object and advantage of the present invention to provide a housing for a toilet sanitizing disk, wherein disks may be replaced in the housing as needed.

Other objects and advantages of the present invention will in part be obvious, and in part appear hereinafter.

SUMMARY OF THE INVENTION

In accordance with the foregoing objects and advantages, the present invention provides a housing in which a conventional sanitizing disk may be placed. The housing is adapted to be positioned in fluid communication between a toilet tank's fill and overflow tubes.

The housing generally includes a body portion having a planar bottom wall and a rigid conduit extending in fluid communication, tangentially outwardly from its sidewall. A neck portion extends concentrically downwardly from the bottom wall and into the overflow tube, while remaining in fluid communication with the housing's body. The bottom wall sits flush with the upper end of the overflow tube (alternatively, the bottom wall could sit slightly above the overflow tube by incorporating tapered fins into the structure of the neck portion which extends downwardly from the bottom wall) and the flexible tube extending from the fill tube is attached to the conduit, thereby ensuring that the water must pass through the housing prior to entering the overflow tube.

A cup for containing the sanitizing disk is positioned within the body portion. A water turbine generator and drive gear cooperate to cause rotation of the cup as water passes into the housing. To effect the rotation, a series of vanes annularly positioned about the generator are impinged by the water introduced into the housing through the conduit, thereby causing the generator to rotate. The inner peripheral surface of the generator includes teeth which are matingly engaged by the drive gear, thereby causing the drive gear to rotate about its fixed, radial axis. The drive gear, in turn, matingly engages a gear fixedly secured to, and concentrically positioned with respect to the cup, thereby translating the rotational motion to the cup. A series of holes formed through the cups sidewalls, coupled with the water rising off of the vanes causes the water to pass over and under the sanitizing disk prior to its entry into the overflow tube.

A lid is hingedly connected to the top of the housing's body for manual, pivotal movement thereof into and out of covering relation to the body portion. Accordingly, sanitizing disks may be removed and replaced as needed.

BRIEF DESCRIPTION OF THE DRAWINGS

The foregoing and other features of the present invention shall be more readily understood with reference to the following Detailed Description, when read in conjunction with the accompanying drawings, wherein.

DETAILED DESCRIPTION

Figure 1:
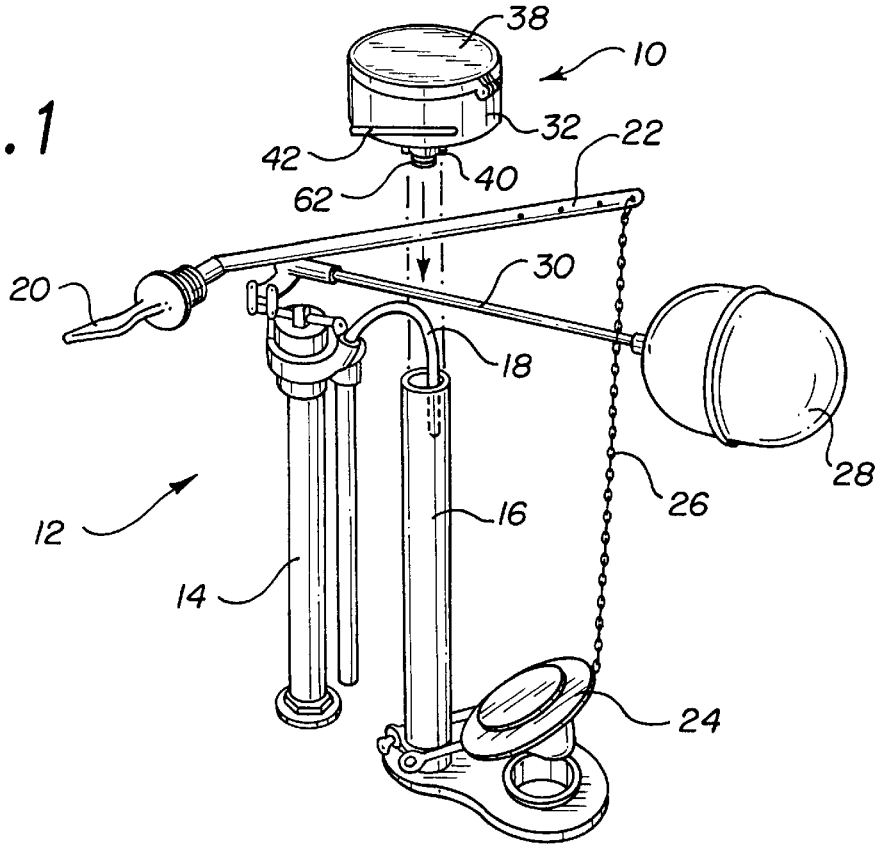
FIG. 1 is a perspective view of a conventional toilet tank assembly with the present invention shown in spaced relation above the overflow tube.
Figure 2:
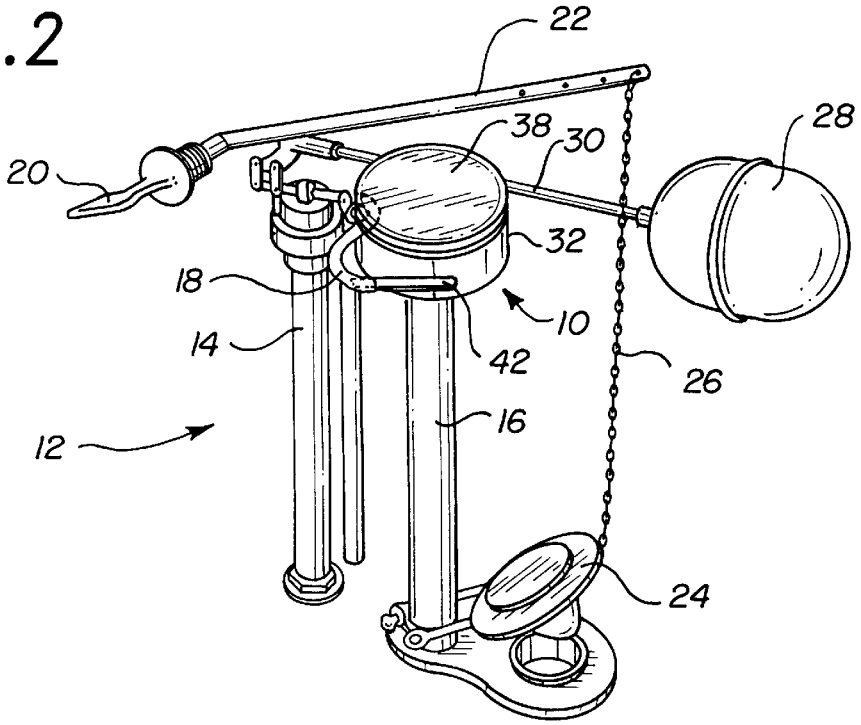
FIG. 2 is a perspective view of a conventional toilet tank assembly with the present invention assembled therein.
Figure 3:
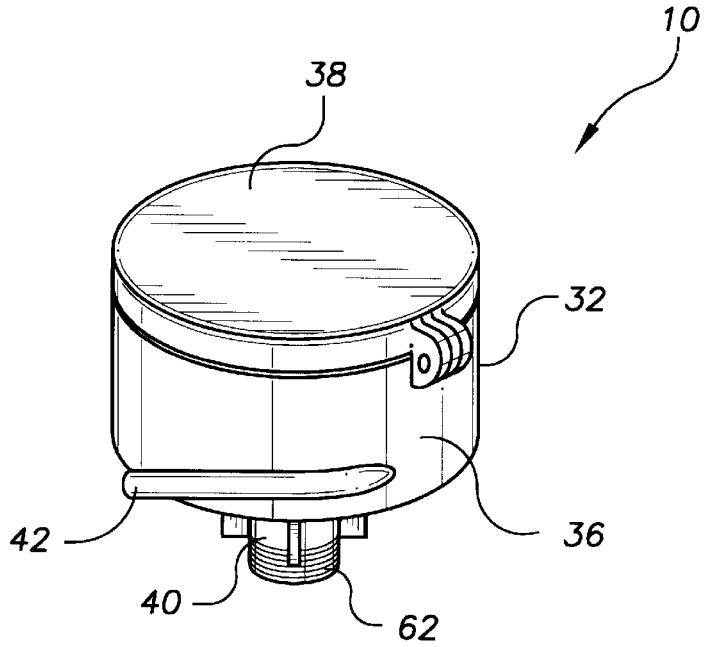
FIG. 3 is a perspective view of the present invention.

Referring now to the drawings, wherein like reference numerals refer to like parts throughout, there is seen in FIG. 1 a housing, denoted generally by reference numeral 10, for containing a conventional toilet sanitizing disk (not shown). Housing 10 is adapted to be incorporated into a conventional toilet tank assembly, denoted generally by reference numeral 12 (see FIGS. 1–2), or a MANSFIELD® type tank assembly 12' (see FIGS. 8–9).

Prior to discussing the details of the present invention, for purposes of understanding, tank assembly 12 will be described. Tank assembly 12 is essentially comprised of a fill tube (or ballcock) 14 which is in fluid communication with an overflow tube 16, via flexible tube 18. To flush a toilet, a handle 20 is pivotally actuated, causing a trip lever 22, which is cantilevered thereto, to raise a flapper valve 24, thereby permitting the fresh tank water to be dispensed from the tank into a bowl. A lift chain 26 interconnects trip lever 22 to flapper valve 24 to effect this translatory motion. As the water level in the tank drops, a float ball 28 correspondingly drops. Float ball 28 is connected via an arm 30 to fill tube 14, and when it drops to a predetermined level, it opens fill tube 14 which permits water to be released from fill tube 14, through tube 18 and into overflow tube 16. As new water passes out the bottom of overflow tube 16, it enters the tank, adjacent flapper valve 24. This causes a change in pressure which results in flapper valve 24 closing, thereby resulting in the tank filling, float ball 28 rising, and, ultimately, fill tube 14 closing.

Figure 6:
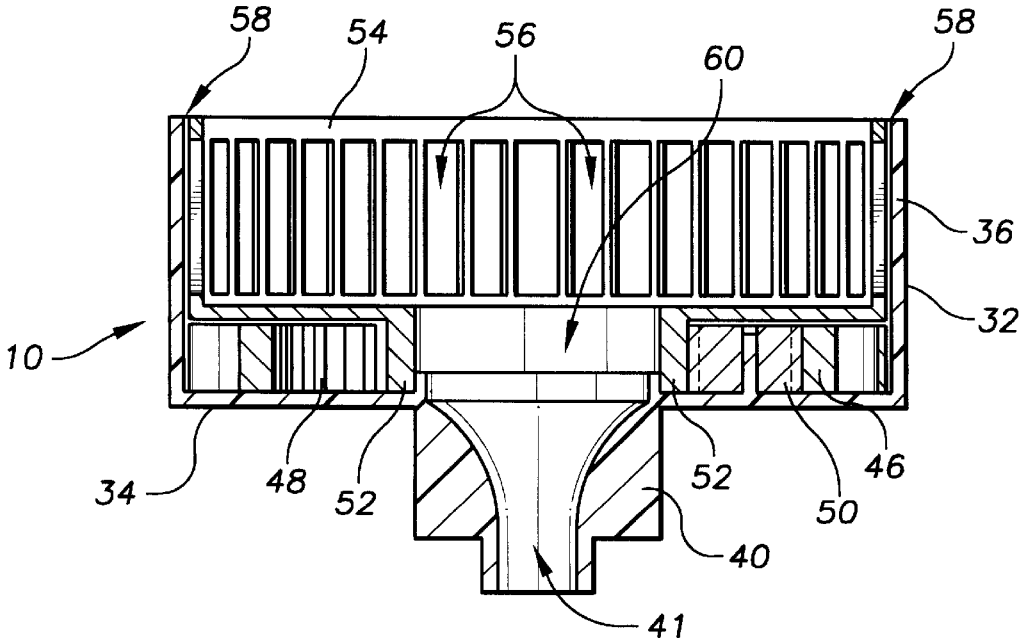
FIG. 6 is a cross-sectional view of the present invention taken along section line 6—6 of FIG. 4.

Housing 10 includes a body portion 32 having a planar, bottom surface 34 and an annular sidewall 36 extending upwardly from bottom surface 34. A lid 38 is hingedly connected for pivotal movement into and out of covering relation to body portion 32, thereby permitting sanitizing disks to be removed from and replaced within housing 10. A neck 40 having a funnel-shaped cavity 41 (see FIG. 6) defined therethrough, extends downwardly from bottom surface 34 and is positioned in concentric, fluid communication with body portion 32.

Figure 4:
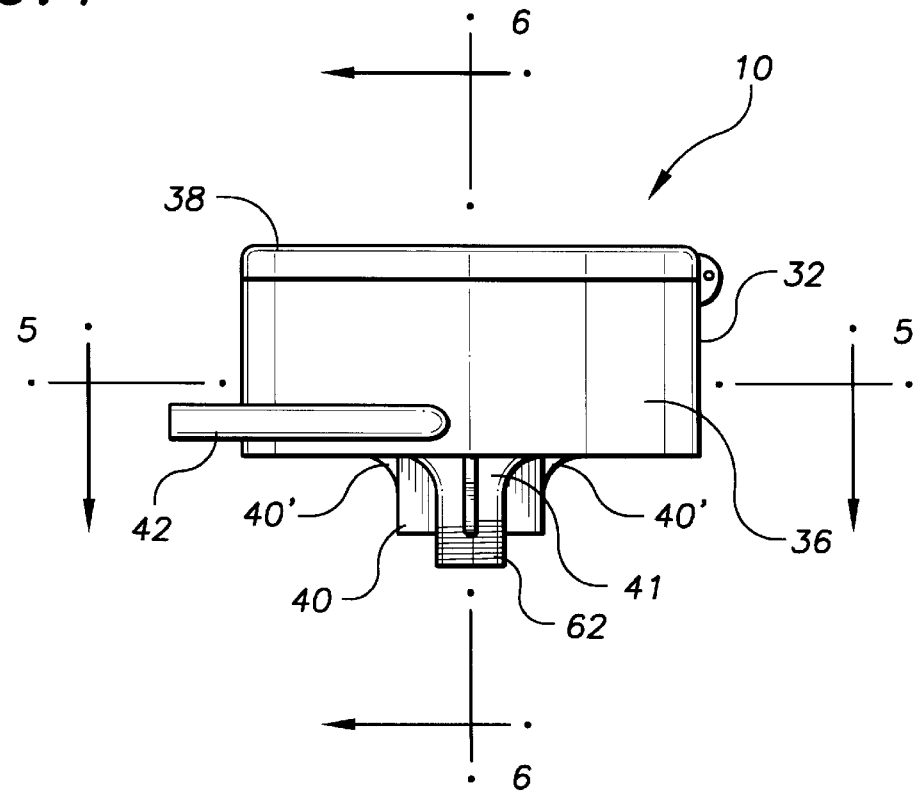
FIG. 4 is a front elevational view of the present invention.

Housing 10 is positioned atop overflow tube 16 with neck 40 extending downwardly therein, and bottom surface 34 extending essentially co-planar with the upper end thereof. Alternatively, tapered fins 40' (see FIG. 4) could be integrally molded in circumferentially spaced relation to the outward surface of neck 40 which would permit bottom surface 34 to extend in a plane slightly above the upper end of overflow tube 16, thereby leaving a slight clearance and permitting the overflow tube to spill over in the event of the toilet malfinctioning. Flexible tube 18 extends from fill tube 14 and connects to rigid conduit 42 which extends tangentially outwardly from, and in fluid communication with sidewall 36, thereby causing the water going from fill tube 14 to overflow tube 16 to first pass through housing 10. Due to neck 40 extending into tube 16, all the water passing through housing 10 will ultimately pass into tube 16.

Figure 5:
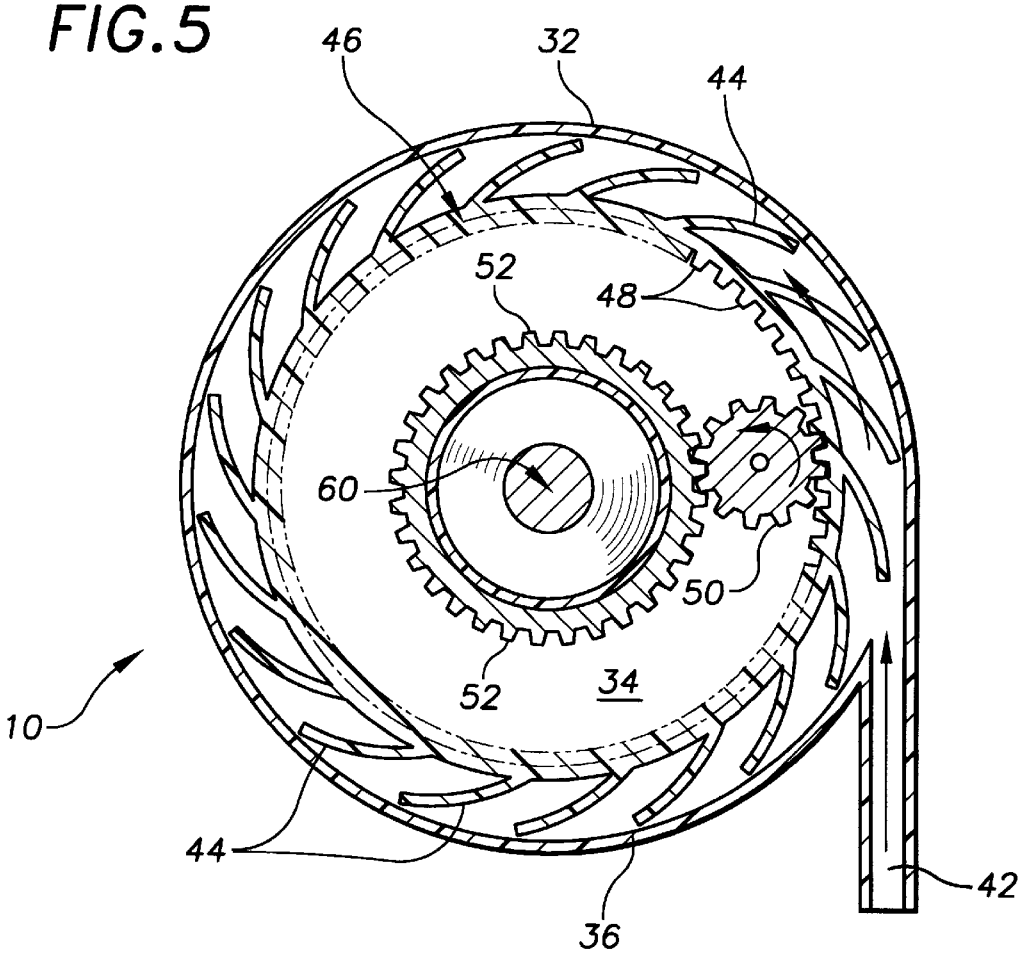
FIG. 5 is a cross-sectional view of the present invention taken along section line 5—5 of FIG. 4.
Figure 7:
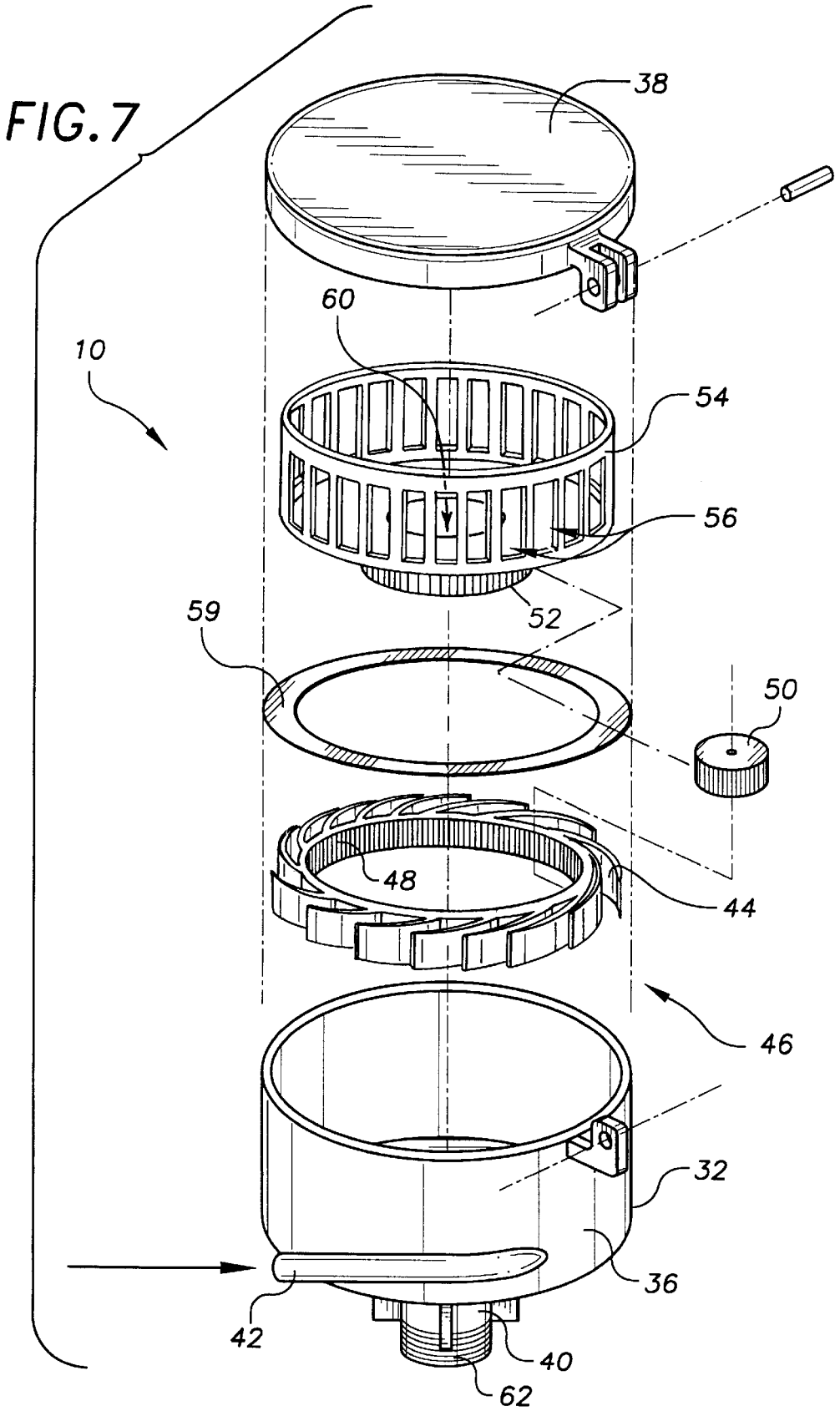
FIG. 7 is an exploded, perspective view of the present invention.

With specific reference being had to FIGS. 5 and 7, as water tangentially enters housing 10 through conduit 42 in the direction indicated by the arrows shown in FIG. 5, it impinges upon a series of vanes 44 which are positioned equidistant apart, annularly around a generator, denoted generally by reference numeral 46. Generator 46 includes teeth 48 contiguously formed around its inner, peripheral surface, and as the water impinges upon vanes 44, thereby causing generator 46 to rotate about its central, radial axis, teeth 48 cause a gear 50, which is positioned in mating relation therewith, to also rotate in a counter-clockwise direction. Gear 50, in turn, meshingly engages another gear 52, on the diametrically opposite side at which it mates with teeth 48 and is concentrically, fixedly attached to the bottom surface of a cup 54 in which the sanitizing disk loosely sits thereby causing cup 54 to rotate in a clockwise direction (e.g., opposite the direction of gear 48). Cup 54 includes a series of evenly spaced openings 56 formed through its sidewall which permit water to pass therethrough.

Important to the dynamics of the present invention, cup 54 is of a diameter slightly smaller than the inner diameter of housing 10, thereby leaving a gap 58 (see FIG. 6) between the two in which water may flow. Also, cup 54 is positioned such that its bottom surface extends in an essentially horizontal plane parallel to and common with, or slightly higher than the plane in which the upper surface of generator 46 extends. A sealing O-ring 59 (e.g., a flat washer) may be positioned between the two, thereby separating them by its thickness and reducing friction between cup 54 and generator 46. Therefore, in order for the water impinging upon vanes 44 to be forced upwardly into gap 58, and ultimately into cup 54, vanes 44 have a slight, upward incantation or taper to them (which may not be detectable from the drawings), such that as water impinges the vane, the centrifugal force created by the motion coupled with the incantation causes the water to rise. In addition, the centrifugal force realized by the housing coupled with the water passing into cup 54 causes the water to turbulently pass over and under the sanitizing disk. As the water passes under the disk, it falls through a central opening 60 formed through cup 46 and gear 52, and out of housing 10 through funnel 41 to which opening 60 is concentrically aligned. Accordingly, all the water passing from fill tube 14 into overflow tube 16 must pass through housing 10 at which point the water will be sanitized.

Figure 8:
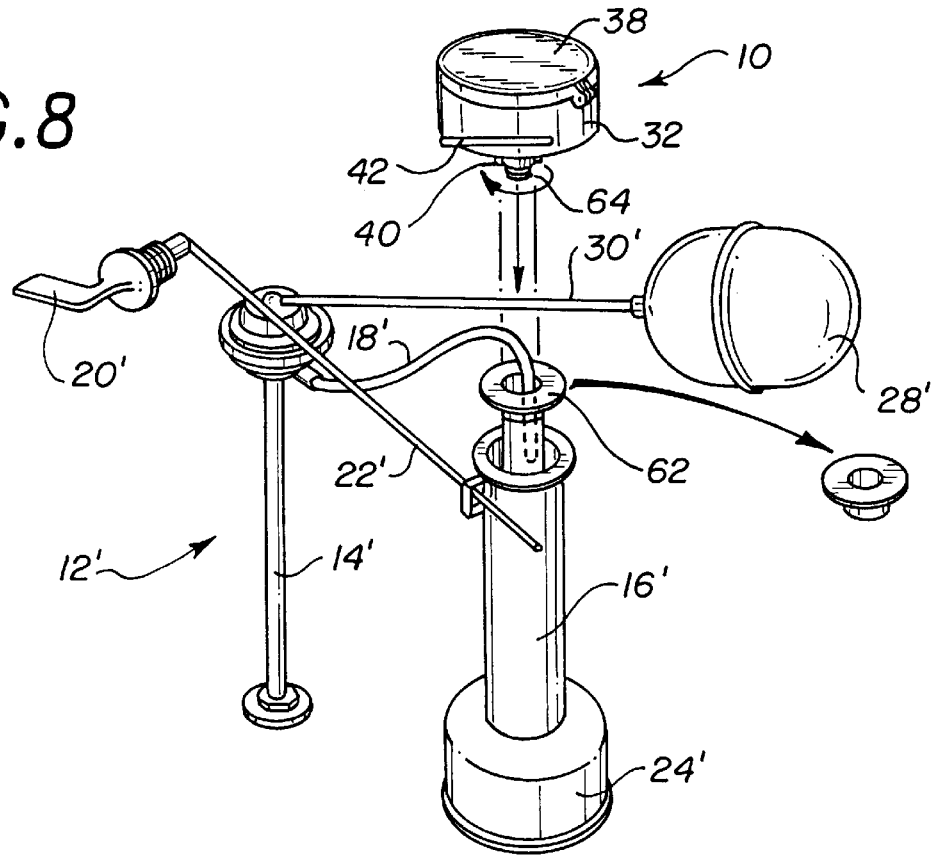
FIG. 8 is a perspective view of a MANSFIELD® toilet tank assembly with the present invention shown spaced above the overflow tube.
Figure 9:
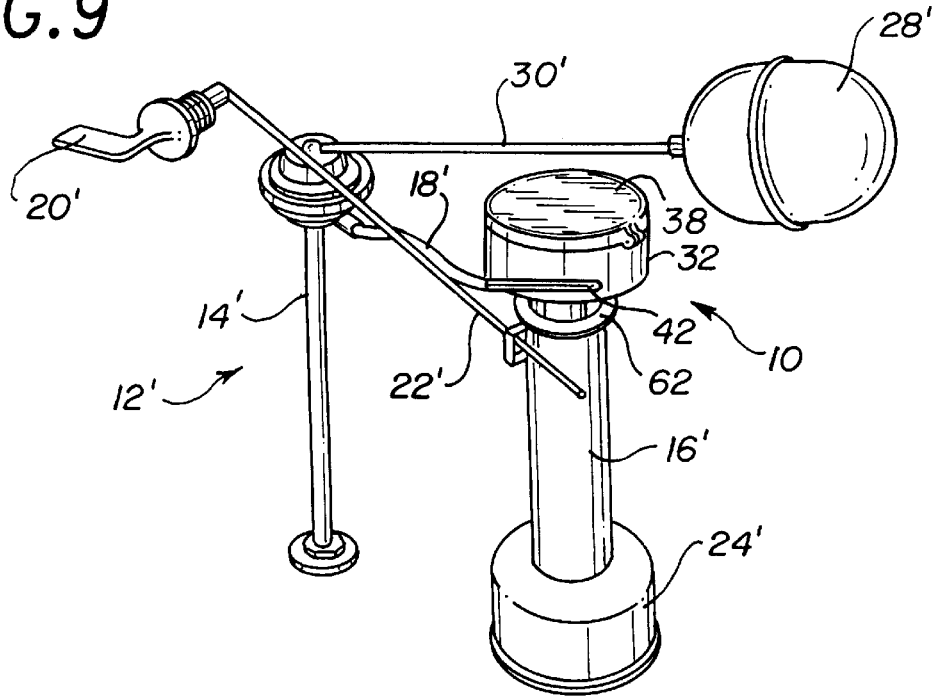
FIG. 9 is a perspective view of a MANSFIELD® toilet tank assembly with the present invention assembled therein.

With specific reference to FIGS. 8–9, the identical housing 10 as described hereabove is shown in use on a MANSFIELD® toilet. For purposes of the present invention, the only difference between a MANSFIELD® toilet and the conventional toilet described earlier is that the MANSFIELD® toilet includes an internally threaded insert 62 positioned at the upper end of overflow tube 16'. In order to provide a more secure connection between housing 10 and overflow tube 16', neck 40 includes a series of external threads 64, thereby enabling a threaded connection between the two elements.

Although a preferred embodiment of the present invention has been set forth hereinabove, it should be understood that modifications may be made to the present invention without departing from its full spirit and scope which is defined by the following claims.

What is claimed is:

1. A housing for a sanitizing disk for use in a toilet having a fill tube and an overflow tube, said housing comprising:

a) a sanitizing disk container having a vertical axis extending centrally therethrough, an essentially planar bottom wall, at least one, first sidewall extending upwardly therefrom, a lid pivotally connected to said at least one sidewall for movement into and out of covering relation to said container, and a neck portion extending downwardly from said bottom wall, said bottom wall having an opening formed essentially, centrally therethrough and positioned in fluid communication with said neck portion, whereby said container is to be positioned adjacent to and in fluid communication with said overflow tube;

b) conduit means for fluidly connecting said container to said fill tube;

c) means for holding said sanitizing disk within said container and in vertically spaced relation to said container's bottom wall; and d) means for rotating said disk holding means about said vertical axis of said container.

2. The housing according to claim 1, wherein said neck portion includes at least two, spaced apart, tapered fins integrally attached thereto, whereby said tapered fins position said bottom wall of said container in vertically spaced relation to said overflow tube.

3. The housing according to claim 1, wherein said conduit means comprises:

a) a rigid conduit extending tangentially outwardly from said at least one, first sidewall and in fluid communication with the interior of said container; and b) a flexible tube interconnecting said rigid conduit to said fill tube, whereby water may be transported from said fill tube into said container.

4. The housing according to claim 1, wherein said disk holding means is comprised of a cup having a bottom wall with an opening formed centrally therethrough and at least one, second sidewall extending upwardly therefrom, whereby said sanitizing disk may be positioned within said cup.

5. The housing according to claim 4, wherein said at least one, second sidewall includes a plurality of openings formed therethrough.

6. The housing according to claim 4, wherein said means for rotating said cup is comprised of:

a) a first gear fixedly attached to and extending downwardly from said cup's bottom wall, and positioned concentrically around said opening formed through said cup's bottom wall;

b) a circularly shaped generator having an opening formed centrally therethrough, an inner surface having a plurality of teeth formed therein, and an outer surface having a plurality of vanes circumferentially positioned therearound; and c) a second gear positioned in meshing engagement between said first gear and some of said plurality of teeth, whereby as water enters said container through said rigid conduit means, said water impinges upon said vanes, thereby causing said generator to rotate as a result thereof, and consequently imparting rotational motion to said cup through said first and second gears.

7. The housing according to claim 6, and further comprising an O-ring positioned between said generator and said bottom surface of said cup, whereby said O-ring reduces friction between said generator and said cup.

8. The housing according to claim 1, wherein said neck portion includes a tapered opening extending centrally therethrough.

* * * * *